US007699419B2

(12) United States Patent
Lin et al.

(10) Patent No.: US 7,699,419 B2
(45) Date of Patent: Apr. 20, 2010

(54) SPACING-SENSING APPARATUS FOR USE IN A PRINTING MODULE OF PRINTER

(75) Inventors: Hsien-Chang Lin, Hsi Chih (TW); Chen-Chien Tsai, Hsi Chih (TW)

(73) Assignee: Great Computer Corporation, Taipei Hsien (TW)

( * ) Notice: Subject to any disclaimer, the term of this patent is extended or adjusted under 35 U.S.C. 154(b) by 187 days.

(21) Appl. No.: 12/005,426

(22) Filed: Dec. 27, 2007

(65) Prior Publication Data

US 2009/0174746 A1 Jul. 9, 2009

(51) Int. Cl.
*B41J 25/308* (2006.01)

(52) U.S. Cl. ..... 347/8

(58) Field of Classification Search ..... None
See application file for complete search history.

(56) References Cited

U.S. PATENT DOCUMENTS 5,806,992 A * 9/1998 Ju ..... 400/56

5,872,579 A * 2/1999 Handa et al. ..... 347/8

* cited by examiner

*Primary Examiner*—Matthew Luu
*Assistant Examiner*—Justin Seo
(74) *Attorney, Agent, or Firm*—Muncy, Geissler, Olds & Lowe, PLLC

(57) ABSTRACT

A spacing-sensing apparatus for use in a printing module of printer is disclosed. The spacing-sensing apparatus includes an oscillating device pivotally disposed on the frame of printing module, wherein the oscillating device has a swing body designed to be rotatably disposed on the lateral plate of the frame, and one end of the swing body is capable of making contact with the surface of a print media when the printing module descends to a predetermined distance from the printing module to the print media, allowing rotation of the other end thereof to trigger switch means for stopping the descending of printing module.

13 Claims, 4 Drawing Sheets

SPACING-SENSING APPARATUS FOR USE IN A PRINTING MODULE OF PRINTER

FIELD OF THE INVENTION

The present invention relates to a spacing-sensing apparatus for use in a printing module of printer, and particularly to the use of an oscillating device for triggering switch means at a predetermined altitude above a print media to send out an alarm message when the printing module approaches the print media.

BACKGROUND OF THE INVENTION

Large inkjet printers are well developed and known that the ejected inks under an appropriate curing process would appear highly desirable and afford a tough, durable image upon print media to which they are applied. This makes the large inkjet printers especially applicable to printing on various print media with different properties or thickness such as plastics packaging, conventional cellulosic substrates and synthetic polymeric substrates. Thus, large inkjet printers can make images more easily, more quickly and more inexpensively than the gravure printing system with a pre-processing taking much cost and times.

In the conventional large inkjet printer, print media receiving the printed image rests on a horizontally extending sliding table, which is situated below a movable carriage carrying a printing module. The printing module includes a plurality of ink containers and a plurality of ink cartridges in fluid communication with the containers, with each cartridge provided with a bottom nozzle to emit droplets of differently colored ink onto the print media. Thus, the inkjet printing module is controlled by a computer which is programmed to moved along a carriage track across the sliding table and energize nozzles of print heads as the printing module traverses across the print media. The ink droplets on the print media is then cured by curing devices, such as an ultraviolet irradiator device, to provide the desired final image.

Various print media of different characteristics (e.g., thickness and hardness) can be applied and printed by the large inkjet printer, and the altitude of printing module above the print media needs to be readjusted in accordance with characteristics of the print media, such that the distance between nozzles of print heads and the print media can remain in an optimum degree for printing. In the beginning of the printing reproduction operation, operators need to prepare proof printing which comprises adjusting the distance of the printing module to the print media and emitting ink droplets to a print media, before the actual reproduction operation, to adjust the printing module to a proper height and verify if the layout is as desired. However, the preparation of this proof will increase the production time and printing cost, and this may be economically disadvantageous when the printing media is an expensive material. On the other hand, this proof process may damage the nozzles when the printing module is overlowered causing the nozzles to knock against the print media.

Accordingly, there is a need for an improved large inkjet printer to preset the altitude of printing module above the print media to reduce cost and make a high throughput to overcome the shortcomings of the prior art.

SUMMARY OF THE INVENTION

It is an object of the present invention to provide a spacing-sensing apparatus for use in a printing module of printer. The frame of printing module comprises an oscillating device, which is pivotally disposed thereon for allowing rotation of the oscillating device to trigger switch means for stopping the approaching of print module toward the print media when the printing module reaches a predetermined altitude above the print media.

To achieve the above stated objects, the present invention provides a spacing-sensing apparatus for use in a printing module wherein the spacing-sensing apparatus comprises an oscillating device pivotally disposed on the frame of printing module, the oscillating device having a swing body designed to be rotatably disposed on the lateral plate of the frame, wherein one end of the swing body is able to contact with surface of the print media at a predetermined altitude above the print media when the printing module approaches the print media, allowing rotation of the other end thereof to trigger switch means for stopping the moving of printing module.

According to an embodiment of the present invention, the swing body further includes a wheel in one end for contacting the surface of print media, and the swing body is connected with spring means having one end mounted to the frame and the other end joined to the middle portion of swing body for providing a tensioned force which assists in swinging of the swing body, such that the spring means is linked between the frame and the middle portion of swing body for providing a tensioned force which assists in swinging of the swing body to trigger a communicator for alerting.

Other objects, advantages and novel features of this invention will become more apparent from the following detailed description when taken in conjunction with the accompanying drawings.

DETAILED DESCRIPTION OF THE PREFERRED EMBODIMENT

Figure 1:
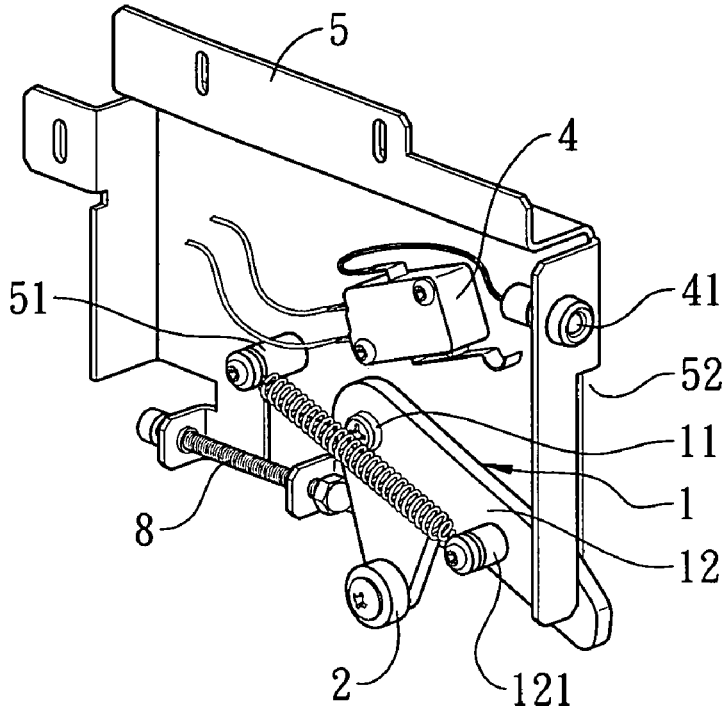
FIG. 1 is a perspective view of the first embodiment of the spacing-sensing apparatus according to the present invention.
Figure 2:
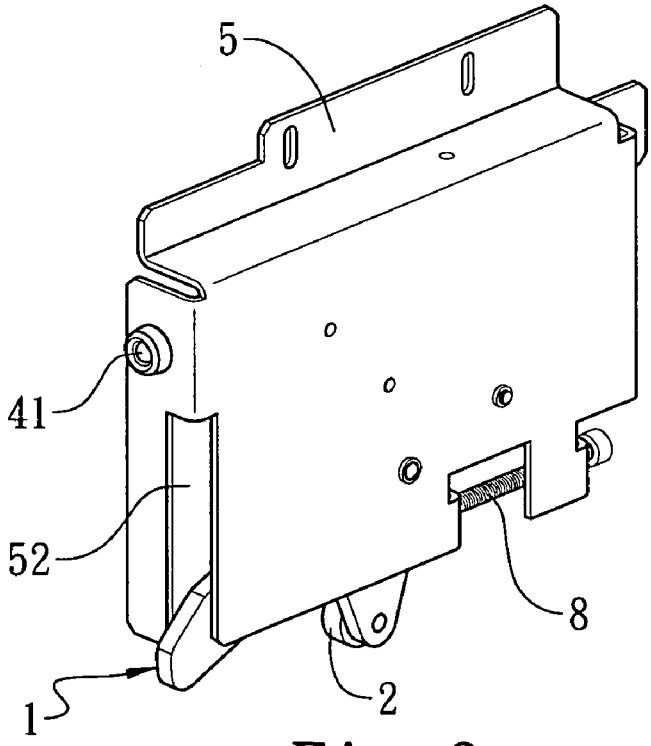
FIG. 2 is another perspective view of the first embodiment of the spacing-sensing apparatus according to the present invention.
Figure 3:
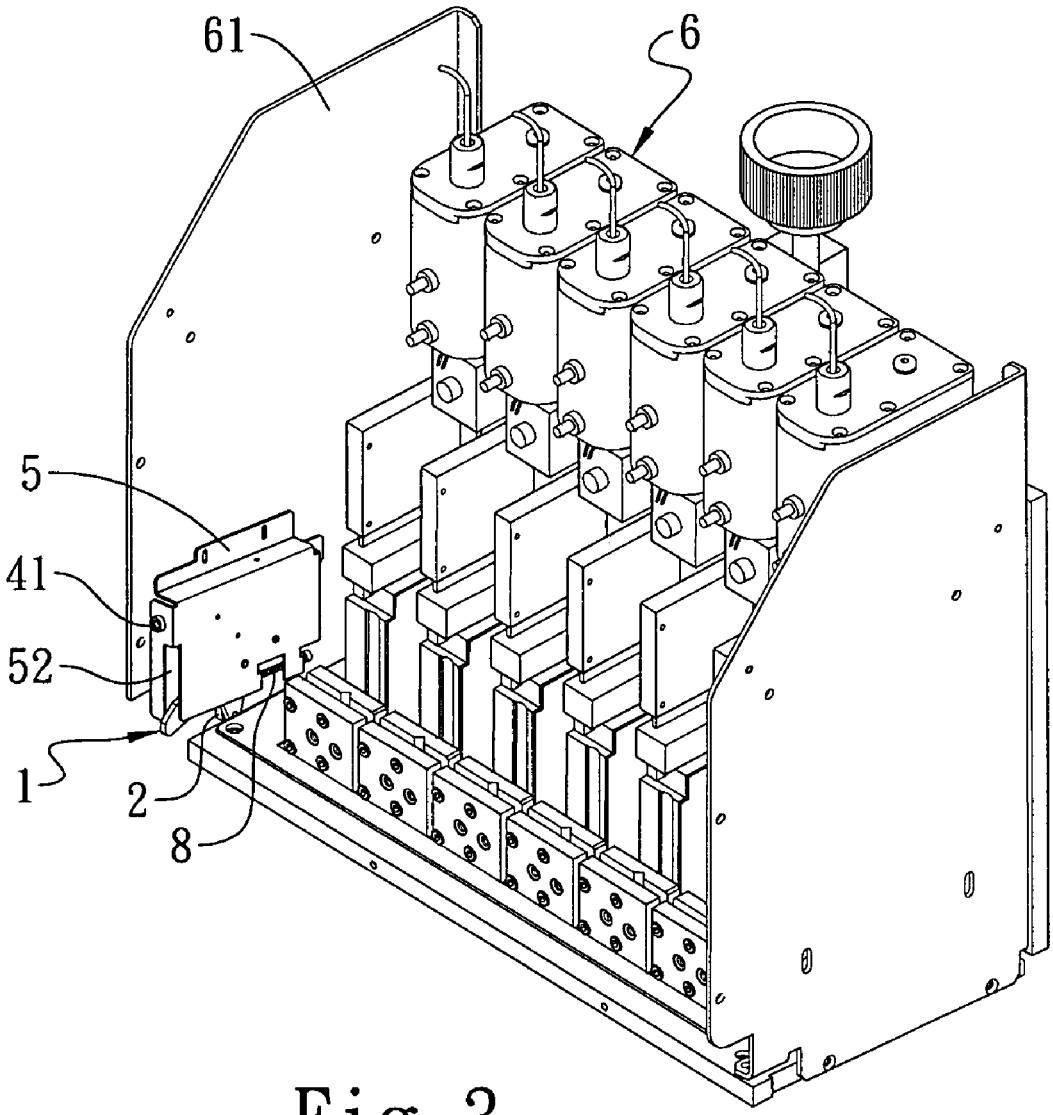
FIG. 3 is a perspective view of the first embodiment illustrating the spacing-sensing apparatus disposed on a printing module.

Referring to FIG. 1 and FIG. 2, there is shown a first embodiment of a spacing-sensing apparatus constructed in accordance with the present invention for use in a printing module of printer. The spacing-sensing apparatus comprises an oscillating device 1, a wheel 2, a spring means and a switch means 4, which are disposed on a housing member 5 designed to be secured on the frame of the printing module 6 (as shown in FIG. 3), to construct a standardized unit for flexibility and maintaining in use.

Figure 4A:
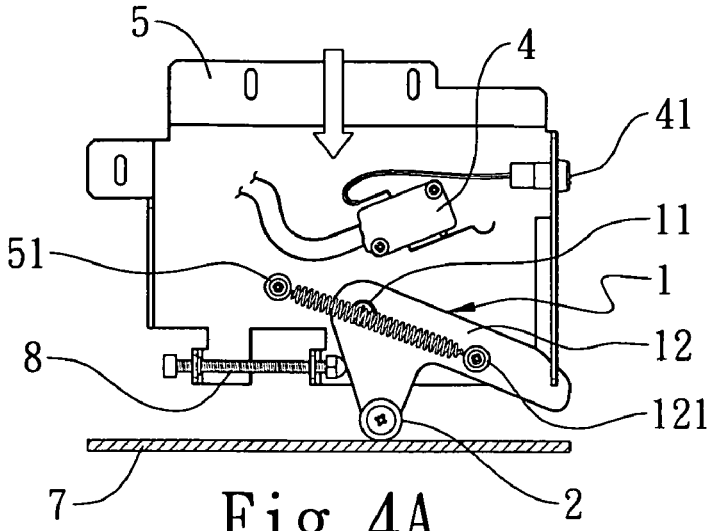
FIG. 4A-4C are perspective views showing the status of the spacing-sensing apparatus when the printing module descends toward to print media.

The oscillating device 1 is pivotally disposed on the housing member 5 via a bolt 11, and includes a swing body 12 designed to be capable of rotating on the lateral plate 61 of the frame. The wheel 2 is disposed in one end of the swing body 12 for touching the surface of a print media 7 (as shown in FIG. 4A). The switch means 4 is disposed on the part of the housing member 5 higher than the swing body 12, and the switch means 4 is electrically connected to a communicator 41 for alerting to allow the other end of the swing body 12 to touch the switch means 4 when the swing body 12 rotates upwardly.

The spring means includes an extension spring. Attached to one end of the extension spring is a first projection 51, which is in turn attached to the housing member 5. This secures the extension spring at its rear end to the housing member 5. The front end of extension spring opposite the first projection 51 is joined to a second projection 121 which is in turn attached to the middle portion of swing body 12, such that the extension spring is generally aligned between the housing member 5 and the swing body 12 for providing a tensioned force which assists in rapid swinging of the swing body 12 about bolt 11.

Moreover, the housing member 5 further includes a setscrew 8 for supporting the swing body 12 and adjusting the position thereof.

Figure 4B:
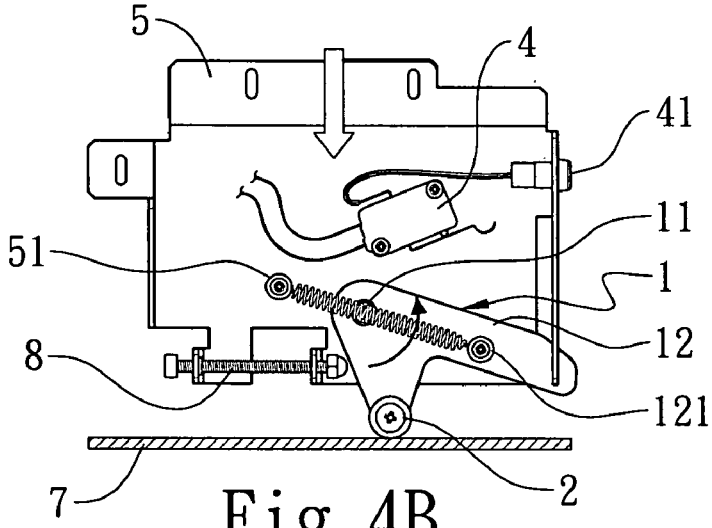
Figure 4C:
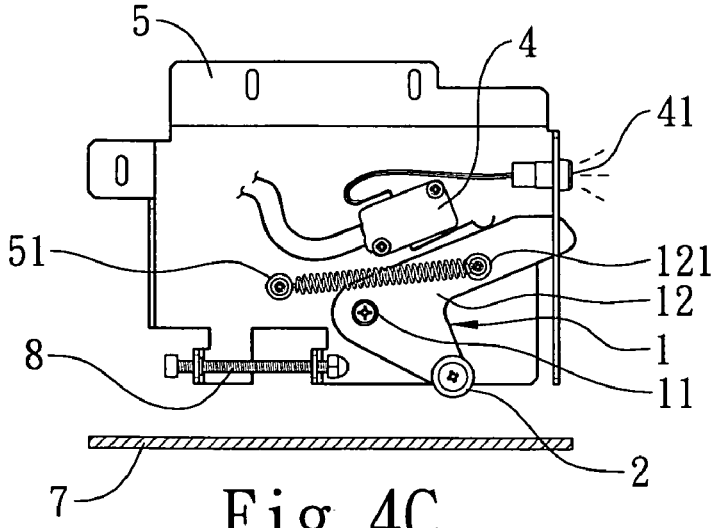

As illustrated in FIG. 4A-4C, as the printing module 6 moves downward the print media 7, the wheel 2 of the swing body 12 comes in contact with the surface of print media 7 at a predetermined altitude above the print media and rolls toward the front end of extension spring. As such, the extension spring is stretched and tensioned by a simple upward motion of the swing body 12. Therefore, once the extension spring upwardly moves across the position of bolt 11, the stretched extension spring can provide a contraction force which assists in a quick and upward motion of the swing body 12 to allow the other end of the swing body 12 to trigger the switch means 4 for stopping the descending of printing module 6.

Preferably, the communicator 41 is a lamp or a speaker.

Preferably, the housing member 5 further includes an indentation 52 closely proximate to the other end of swing body 12 for restraining rotation of the swing body 12 when the swing body 12 triggers the switch means 4.

Figure 5:
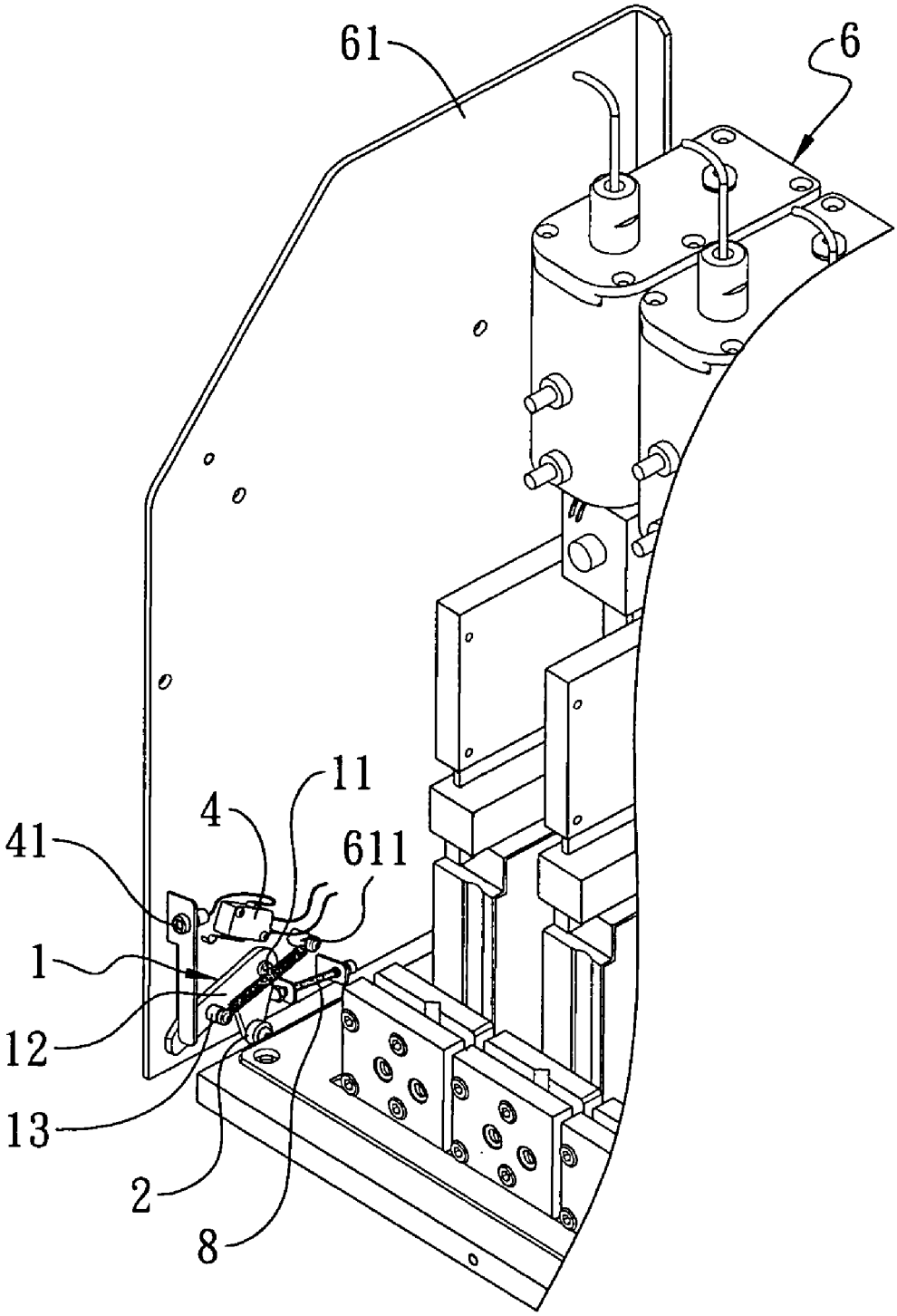
FIG. 5 is a perspective view of the second embodiment according to the present invention.

In addition, the spacing-sensing apparatus according to the present invention can be directly disposed to the printing module 6. FIG. 5 illustrates a second embodiment of the spacing-sensing apparatus constructed in accordance with the present invention for use in a printing module of printer. The spacing-sensing apparatus comprises an oscillating device 1, a wheel 2, a spring means and a switch means 4.

The oscillating device 1 is pivotally secured on the lateral plate 61 of the printing module 6 via a bolt 11, and includes a swing body 12 designed to be capable of rotating on the lateral plate 61 of the printing module 6. The wheel 2 is disposed in one end of the swing body 12 for touching the surface of a print media 7. The switch means 4 is disposed on the part of the housing member 5 higher than the swing body 12, and the switch means 4 is electrically connected to a communicator 41 for alerting to allow the other end of the swing body 12 to touch the switch means 4 when the swing body 12 rotates upwardly.

The spring means includes an extension spring. Attached to one end of the extension spring is a projection 611, which is in turn attached to the lateral plate 61 of the printing module 6. This secures the extension spring at its rear end to the printing module 6. The front end of extension spring opposite the projection 611 is joined to a second projection 121 which is in turn attached to the middle portion of swing body 12, such that the extension spring is generally aligned between the printing module 6 and the swing body 12 for providing a tensioned force which assists in rapid swinging of the swing body 12 about the projection 611.

Moreover, the present invention further includes a setscrew 8 disposed on the part of the printing module 6 behind the swing body 12 for supporting the oscillating device 1 and adjusting the position thereof.

While the printing module 6 moves downward and reaches a predetermined altitude above the print media 7, the wheel 2 of the swing body 12 comes in contact with the surface of print media 7 and rolls toward the front end of extension spring. As such, the extension spring is stretched and tensioned by a simple upward motion of the swing body 12. Therefore, once the extension spring upwardly moves across the position of bolt 11, the stretched extension spring can provide a contraction force which assists in a quick and upward motion of the swing body 12 to allow the other end of the swing body 12 to trigger the switch means 4 for stopping the descending of printing module 6.

From the foregoing, it is apparent that the present invention is advantageous in that:

1. By combination of the printing module and the oscillating device having an extension spring aligned therebetween, the oscillating device can be rapidly swung to trigger an alarm communicator for stopping the adjustment of printing module when the printing module reaches a predetermined altitude above the print media.
2. According to the present invention, the position relative to the print media and the sensitivity of oscillating device can be easily adjusted in accordance with the characteristics of print media and thereby increase the printing quality and stability by setting the printing module at a optimum height relative to the print media.
3. The housing member of present invention has an indentation closely proximate to the other end of swing body for restraining rotation of the swing body when the swing body triggers the switch means to avoid the direct strike from the swing body to the switch means, thereby prolonging the life time of the switch means.
4. The present invention has simplified components which allow the device to be made more compact and less expensive.

As stated in the above disclosed, the present invention can surely achieve its expected objects to provide spacing-sensing apparatus for use in a printing module of printer to send out a signal for stopping the descending of print module when the printing module descends to a predetermined distance from the printing module to the print media.

It should be understood that different modifications and variations could be made from the disclosures of the present invention by the people familiar in the art without departing the spirit of the present invention.

What is claimed is:

1. A spacing-sensing apparatus for use in a printing module of printer, comprising:

an oscillating device pivotally disposed on a frame of printing module, the oscillating device having a swing body designed to be rotatably disposed on one lateral plate of the frame, wherein one end of the swing body is contactable with surface of a print media at a predetermined altitude above the print media when the printing module approaches the print media, allowing rotation of the other end of swing body to trigger switch means for stopping the descending of printing module wherein the switch means is electrically connected to a communicator for alerting a human user, that the descending of the printhead is stopped.

2. The spacing-sensing apparatus as claimed in claim 1, further includes a housing member on the lateral plate of the frame provided for the oscillating device and the switch means to be disposed thereon.

3. The spacing-sensing apparatus as claimed in claim 2, further includes spring means having one end mounted to the housing member and the other end joined to the middle portion of swing body for providing a tensioned force which assists in swinging of the swing body.

4. The spacing-sensing apparatus as claimed in claim 3, wherein the swing body further includes a wheel in one end thereof for contacting the surface of print media.

5. The spacing-sensing apparatus as claimed in claim 3, wherein the housing member further includes an indentation closely proximate to the other end of swing body for restraining rotation of the swing body when the swing body triggers the switch means.

6. The spacing-sensing apparatus as claimed in claim 4, wherein the housing member further includes an indentation closely proximate to the other end of swing body for restraining rotation of the swing body when the swing body triggers the switch means.

7. The spacing-sensing apparatus as claimed in claim 1, wherein the swing body further includes a wheel in one end thereof for contacting the surface of print media.

8. The spacing-sensing apparatus as claimed in claim 7, wherein the housing member further includes an indentation closely proximate to the other end of swing body for restraining rotation of the swing body when the swing body triggers the switch means.

9. The spacing-sensing apparatus as claimed in claim 2, wherein the housing member further includes a set screw for supporting the oscillating device and adjusting the position thereof.

10. The spacing-sensing apparatus as claimed in claim 2, wherein the communicator is a lamp.

11. The spacing-sensing apparatus as claimed in claim 2, wherein the communicator is a speaker.

12. The spacing-sensing apparatus as claimed in claim 1, wherein the swing body further includes a wheel in one end thereof for contacting the surface of print media, and the swing body is connected with spring means having one end mounted to the frame and the other end joined to the middle portion of swing body for providing a tensioned force which assists in swinging of the swing body, such that the spring means is aligned between the frame and the middle portion of swing body for providing a tensioned force which assists in swinging of the swing body to trigger a communicator for alerting.

13. The spacing-sensing apparatus as claimed in claim 1, wherein the communicator is a lamp or a speaker.

* * * * *